US008914947B2

(12) United States Patent
Weiss

(10) Patent No.: US 8,914,947 B2
(45) Date of Patent: Dec. 23, 2014

(54) HANDLE ARRANGEMENT

(75) Inventor: Oliver Weiss, Wendelstein (DE)

(73) Assignee: Illinois Tool Works, Inc., Glenview, IL (US)

( * ) Notice: Subject to any disclaimer, the term of this patent is extended or adjusted under 35 U.S.C. 154(b) by 96 days.

(21) Appl. No.: 13/577,067

(22) PCT Filed: Dec. 13, 2010

(86) PCT No.: PCT/US2010/060076

§ 371 (c)(1),
(2), (4) Date: Aug. 3, 2012

(87) PCT Pub. No.: WO2011/100025

PCT Pub. Date: Aug. 18, 2011

(65) Prior Publication Data

US 2013/0025088 A1 Jan. 31, 2013

(30) Foreign Application Priority Data

Feb. 11, 2010 (DE) ..... 20 2010 002 296

(51) Int. Cl.

| | |
|---|---|
| ***B25G 1/10*** | (2006.01) |
| ***B25F 5/02*** | (2006.01) |
| ***B25F 5/00*** | (2006.01) |
| ***B25D 17/04*** | (2006.01) |

(52) U.S. Cl.

CPC ..... *B25F 5/006* (2013.01); *B25F 5/026* (2013.01); *B25D 2250/391* (2013.01); *B25D 17/043* (2013.01)

USPC ..... 16/431; 16/426

(58) Field of Classification Search

USPC ..... 16/422, 426, 431, 436, DIG. 25; 267/137

See application file for complete search history.

(56) References Cited

U.S. PATENT DOCUMENTS

| | | | | |
|---|---|---|---|---|
| 5,157,807 | A * | 10/1992 | Keller et al. | 16/431 |
| 5,170,532 | A * | 12/1992 | Holmin et al. | 16/431 |
| 7,137,542 | B2 * | 11/2006 | Oki et al. | 173/162.2 |
| 7,676,890 | B2 * | 3/2010 | Zhang et al. | 16/431 |
| 8,256,528 | B2 * | 9/2012 | Oesterle et al. | 173/162.2 |
| 2005/0087353 | A1 * | 4/2005 | Oki et al. | 173/162.2 |

(Continued)

FOREIGN PATENT DOCUMENTS

| | | | | |
|---|---|---|---|---|
| CH | 649733 | A5 * | 6/1985 | B25G 3/32 |
| DE | 3304849 | A1 | 11/1983 | |

(Continued)

OTHER PUBLICATIONS

An International Search Report dated Jul. 8, 2011 in International Application No. PCT/US2010/060076.
DE Search Report for 20 2010 002 296.7 dated Mar. 12, 2010.

*Primary Examiner* — Jeffrey O Brien
(74) *Attorney, Agent, or Firm* — Lowe Hauptman & Ham LLP

(57) ABSTRACT

The invention relates to a handle arrangement for a machine component which vibrates in the operating state thereof, with a connecting part for connecting to the machine component and with a handle which is coupled to the connecting part, wherein the handle is assigned an elongate handle section with a hand engagement point and wherein the handle has a damping mass element, the mass center of gravity of which is arranged such that a decrease in vibration in the hand engagement point is achieved.

17 Claims, 3 Drawing Sheets

(56) References Cited

U.S. PATENT DOCUMENTS

Figure 1:
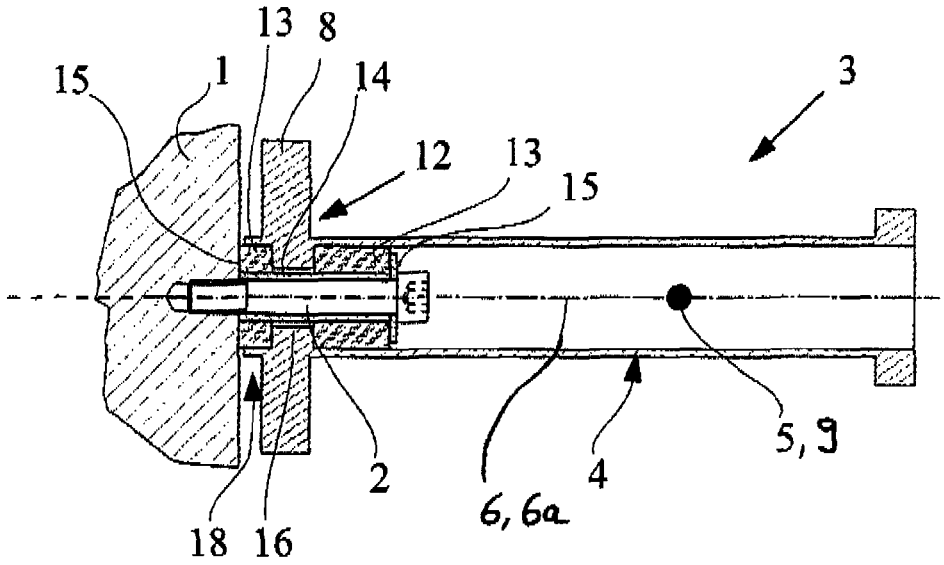

| | | | | |
|---|---|---|---|---|
| 2007/0143966 | A1* | 6/2007 | Fischer | 16/422 |
| 2008/0148524 | A1* | 6/2008 | Wiker et al. | 16/431 |
| 2008/0148525 | A1* | 6/2008 | Krondorfer et al. | 16/436 |
| 2009/0039576 | A1* | 2/2009 | Eicher et al. | 267/137 |
| 2009/0283283 | A1* | 11/2009 | Oesterle et al. | 173/162.2 |
| 2010/0282484 | A1* | 11/2010 | Moessnang et al. | 173/162.2 |
| 2011/0011609 | A1* | 1/2011 | Simm et al. | 173/171 |

FOREIGN PATENT DOCUMENTS

| | | | |
|---|---|---|---|
| DE | 8607168 | U1 | 9/1987 |
| DE | 102007009169 | A1 | 8/2008 |
| DE | 102007047076 | A1 | 4/2009 |
| DE | 102008004875 | A1 | 7/2009 |
| EP | 1415768 | A1 | 5/2004 |
| GB | 2451747 | A | 2/2009 |

* cited by examiner

HANDLE ARRANGEMENT

RELATED APPLICATIONS

The present application is based on International Application No. PCT/US2010/060076, filed Dec. 13, 2010 and claims priority from German Application No. 20 2010 002 296.7, filed Feb. 11, 2010.

The invention relates to a handle arrangement according to the precharacterizing clause of claim 1 and to a machine component with a handle arrangement of this type according to claim 17.

Numerous machine components produce vibrations in the operating state thereof, which vibrations are transmitted via the machine housing, a handle arrangement or the like to the machine operator. Vibrations of this type may be a considerable risk to health. One example thereof is the "white finger disease" caused by damaged nerves and cells.

In the present case, the term "vibrations" is to be understood in very general terms as meaning mechanical vibrations which can be felt by the machine operator. Said vibrations may contain linear and nonlinear vibration components.

The above vibrations arise, for example, in striking tools, such as an impact drilling machine, a hammer drill, a chisel hammer or the like. The striking and optionally simultaneously rotating engagement with the respective material being drilled gives rise to vibrations on the handle of the machine component, which vibrations should be reduced.

A known vibration damper for a hammer drill (EP 1 415 768 A1 operates in accordance with the functioning principle of a vibration absorber. A vibration absorber of this type is equipped with a damping mass element which is mounted in a spring-loaded manner in at least one direction of movement. The spring-loaded damping mass element forms a system which is capable of vibration and can be excited by the vibrations of the machine component to provide damping vibrations.

A disadvantage of the known vibration damper simply in terms of structure is that the damping vibration of the damping mass element has to be "accommodated" in the hammer drill without this involving disadvantages with regard to the construction space and/or operation. It has already been proposed to use existing structural members as the damping mass element. However, care should also be taken here to ensure that a damping vibration of said existing structural members does not still have a disadvantageous effect on the hammer drill.

Another disadvantage of the known vibration damper is that a satisfactory damping result can be obtained only within a very narrow frequency range of linear vibrations. However, vibration measurements on striking tools have revealed that, in the operating state, linear and nonlinear vibrations of innumerable frequencies and directions occur. Even if a vibration with a preferred frequency and a preferred direction can be determined in certain cases, at least seen statistically, the damping of said vibration is generally not satisfactory.

Other known considerations are focused on reducing the local vibrations in the region of the hand engagement point of the handle itself by means of a special structure of the handle arrangement of a machine component. The known handle arrangement (DE 33 04 849 C2), on which the invention is based, has a handle with an elongate handle section which is coupled via an elastic body to a connecting part fixed on the machine component. A damping mass element is provided at the free end of the handle section. The arrangement here is such that the natural frequency of the handle lies far below the frequency of the machine vibrations, and therefore the handle is advantageously not excited to vibrate.

However, a disadvantage of the known handle arrangement is that the vibration damping has essentially local effects on the handle. This is not very efficient with regard to the comparatively high realization cost.

The invention is based on the problem of refining and developing the known handle arrangement in such a manner that the efficiency of the measures for damping vibrations is increased.

The above problem is achieved in a handle arrangement according to the precharacterizing clause of claim 1 by means of the features of the characterizing part of claim 1.

The basic consideration is essentially that a certain deflection of the handle in relation to the connecting part can be used in a manner affording advantages both with regard to the damping of the machine vibrations and with regard to the damping of handle vibrations if said deflection can be correspondingly controlled by the structural configuration.

According to the proposal, it is provided that the handle is mounted on the connecting part so as to be slightly deflectable about a geometrical pivot point substantially transversely with respect to the handle axis and has a damping mass element, the mass center of gravity of which with respect to the pivot point, as seen along the handle axis, is arranged on that side of the handle which faces away from the hand engagement point.

The damping mass element is a mass element which, together with the remaining mass of the handle, is decisive for the damping behavior of the handle arrangement, as will be shown.

For the understanding of the term "pivot point", it should be taken into consideration here that the position of said pivot point can vary within a certain range in particular during the deflection of the handle. An exactly consistent position of the pivot point does not matter within the meaning of the present teaching.

Given a suitable configuration, the above deflectability of the handle permits the inertia-induced production of damping vibrations to damp the machine vibrations with the effect of a vibration absorber. At the same time, in turn, given a suitable configuration, the inertia-induced vibration of the handle can be adjusted in such a manner that it leads to a reduction in the handle vibrations which can be felt by the machine operator. This configuration is substantially based on the mass distribution of the handle as a whole and can be controlled by suitable dimensioning and positioning of the damping mass element.

The very considerable degrees of freedom in the structural realization are particularly advantageous in the solution according to the proposal. Owing to the fact that the damping mass element with respect to the pivot point, as seen along the handle axis, is arranged on that side of the handle which faces away from the hand engagement point, in particular on the end side, a structural limitation is provided only to a very small degree if at all by the design of the handle section.

A particularly preferred variant embodiment for realizing the solution according to the proposal is the subject matter of claim 4. The starting point in this case is that machine-side vibrations occur, producing the inertia-induced pendulum vibrations of the handle about the pivot point. These in particular involve vibrations with vibration components which are radial with respect to the handle axis. This production of pendulum vibrations can be influenced inter alia by the configuration already discussed of the damping mass element.

According to claim 4, the handle arrangement should be configured in such a manner that the pendulum vibrations of the handle in relation to the connecting part and the machine-side vibrations acting on the connecting part neutralize one another at a point in the region of the handle part, which point is referred to below as the "rest point" in such a manner that ideally the handle section at the rest point essentially does not undergo any deflection transversely with respect to the handle axis, i.e. is immobilized to a certain extent there.

In actuality, the above ideal state often cannot be achieved because of undesirable deformations or the like. The configuration is then at least undertaken in such a manner that the deflection transversely with respect to the handle axis at the rest point is minimal compared with the deflections, as seen along the handle axis, on both sides of the rest point.

Claims 6 to 8 show preferred refinements for realizing the pivotability of the handle about the pivot point. It is essential here that the handle is coupled to the connecting part via an elastically deformable damping arrangement which permits a corresponding deflection of the handle in relation to the connecting part. Of particular advantage when using a damping arrangement for coupling the handle to the connecting part is that the introduction of the machine vibrations into the handle can be adjusted in diverse ways. At the same time, with a damping arrangement of this type, transmission of actuating forces can be adjusted as required.

It is particularly advantageous according to claim 11 that the damping mass element is provided, as seen along the handle axis, in the region of the damping arrangement such that the mass center of gravity of the damping mass element can be arranged in a simple manner, as seen along the handle axis, adjacent to the pivot point. This enables feedback of the damping mass element to the machine component without long lever travels having to be spanned. This is of significance for damping the machine vibrations.

Claim 15 relates to a particularly preferred configuration of the coupling between the handle and the machine component in general, namely with a clearance which is present at least in the operating state. The effect achieved by said clearance is that the excitation of the handle to provide vibrations by means of the vibrations of the machine component at least in one vibration direction originates from a substantially shocklike interaction between the handle and the machine component.

Vibration energy is therefore not transmitted continuously from the machine component to the handle but rather at discrete time intervals upon the shocklike impact against the respective clearance limit after the clearance has been passed through. The order of magnitude of the time intervals of two above impacts corresponds here to the order of magnitude of the period durations of the vibrations.

The effect which can be achieved with the clearance-effected coupling according to claim 15 is that both linear and nonlinear vibration components contribute to exciting the vibrations of the handle, i.e. act upon the handle with energy. The damping effect of the handle on the machine component for linear and nonlinear vibrations can therefore be optimized within a wide frequency range.

With the shocklike transmission, the effect can also be observed that vibrations having linear and nonlinear components are harmonized, i.e. linearized, at least to a certain degree, this corresponding to a first filtering. Vibrations harmonized in such a manner can easily be handled with regard to an optionally further downstream filtering or the like.

The term "clearance" should be understood here as meaning that the handle is essentially free from the machine component during passage through the clearance. There is no obstacle to the handle being engagement with a damping arrangement or the like as long as the damping arrangement does not measurably affect the deflection of the handle.

The clearance limit may be a hard, inflexible limit or a flexible limit. The last-mentioned case is present in particular if the clearance limit is assigned an elastically deformable damping material.

The term "shocklike" should be interpreted broadly and comprises every impact of the handle against the clearance limits in such a manner that a change in movement of the handle is caused.

Of course, in actual systems, it can never be completely ruled out that the coupling between the handle and the machine component optionally comprises, because of temperature effects, further coupling mechanisms, such as friction, which may result in the handle being additionally excited. Against this background, the teaching according to claim 15 should be understood in such a manner that the excitation of the handle very predominantly originates from the above shocklike interaction.

As a rule, it is possible to assign a vibration direction to the vibrations of the machine component, as seen statistically, wherein the shocklike interaction according to the proposal is intended to act preferably at least in said preferred vibration direction.

In accordance with a further teaching according to claim 17, which likewise is of independent importance, a machine component with an above handle arrangement is claimed. Reference should be made to all of the embodiments relating to the handle arrangement according to the proposal.

Figure 2:
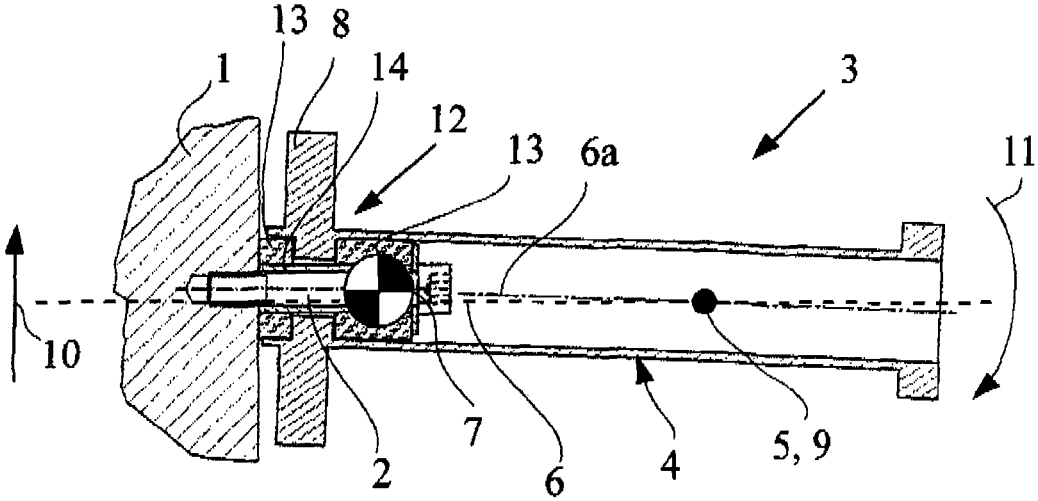
Figure 3:
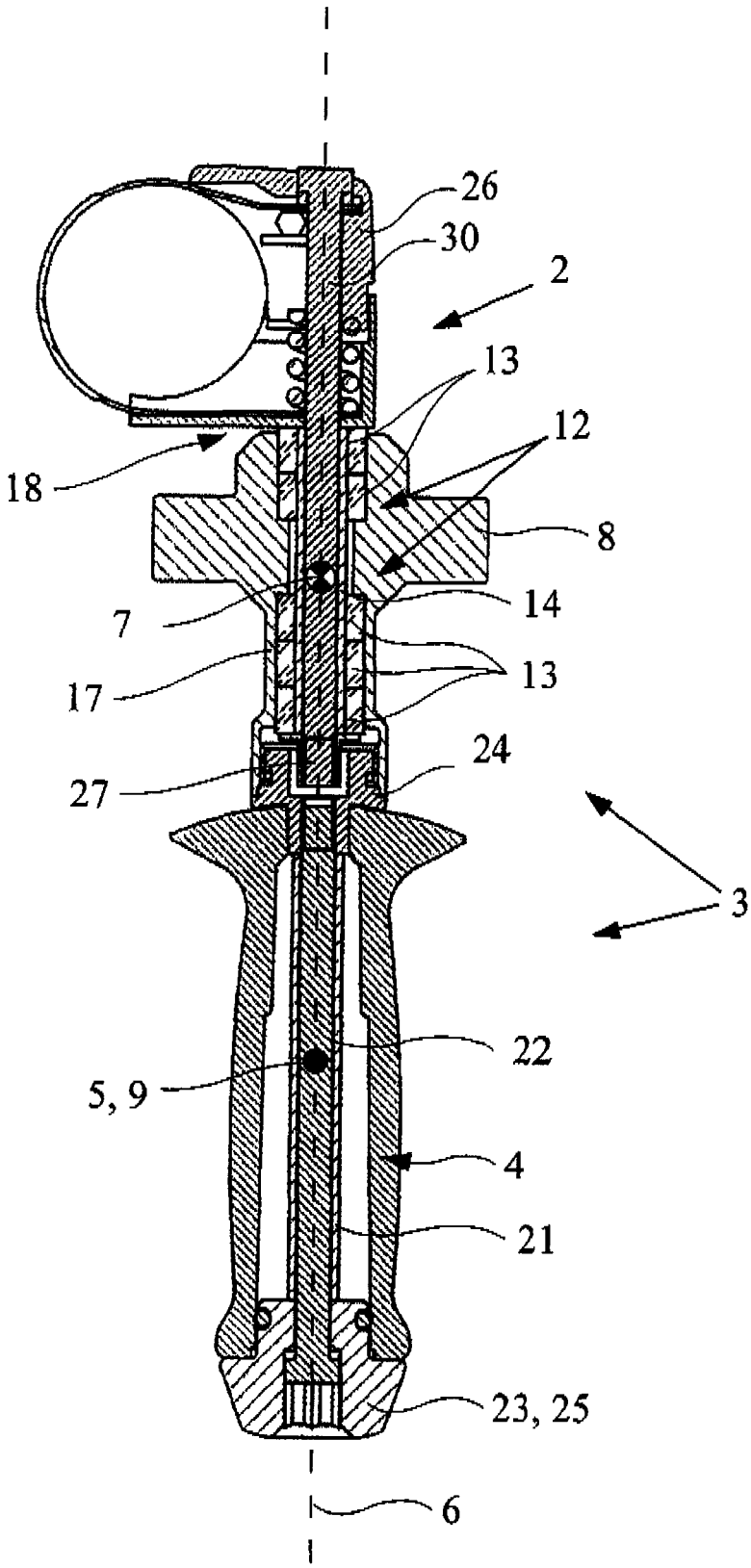
Figure 4:
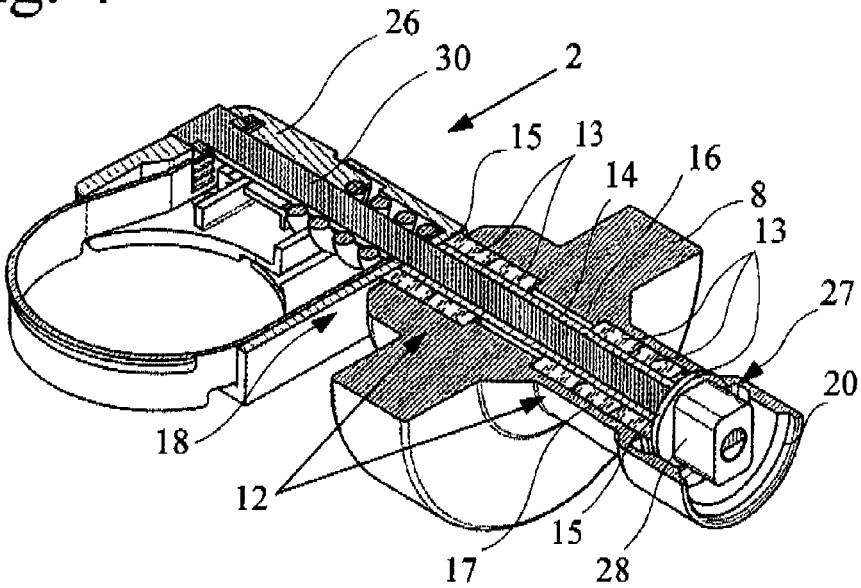
Figure 5:
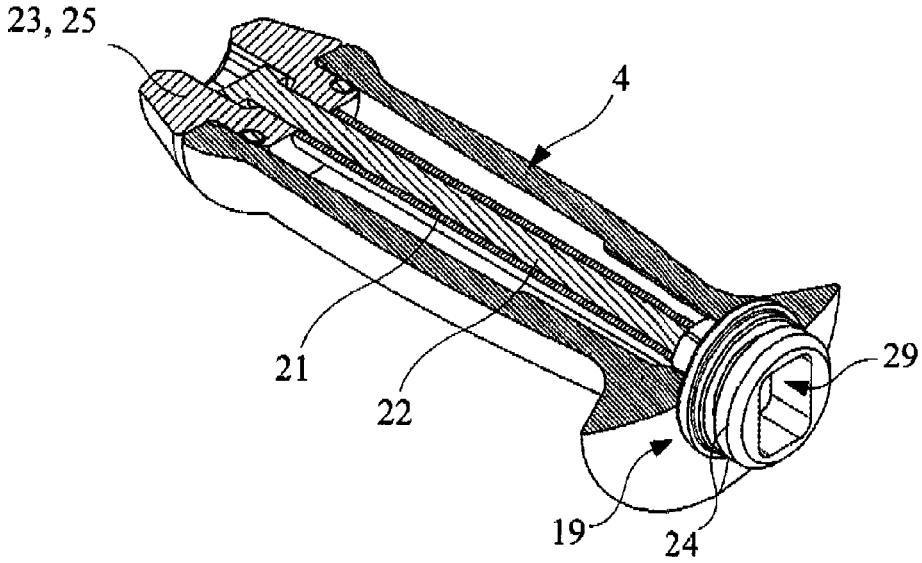

The invention is explained in more detail below with reference to a drawing which merely illustrates exemplary embodiments. In the drawing FIG. 1 shows a sectional illustration in the inoperative state of a first embodiment of a handle arrangement according to the proposal, FIG. 2 shows a sectional illustration of the handle arrangement according to FIG. 1 in the operating state with the handle deflected, FIG. 3 shows a sectional illustration of a further embodiment of a handle arrangement according to the proposal in the non-fitted state, FIG. 4 shows a sectional illustration of the damping section together with the connecting part of the handle arrangement according to FIG. 3 in the partially fitted state, and FIG. 5 shows a sectional illustration of the handle section of the handle arrangement according to FIG. 4 in the partially fitted state.

The handle arrangement according to the proposal and illustrated in two embodiments in the drawing is assigned to a machine component 1 which is merely indicated in FIG. 1 and vibrates in the operating state thereof.

In the present case, the term "vibrating machine component" should be understood in broad terms. This includes any arrangement vibrating in the operating state thereof. Examples thereof include tools, in particular striking tools, such as impact drilling machines or hammer drills, machine tools or the like. However, examples of use in the sphere of vehicles, in particular of motor vehicles or motorcycles, are also conceivable here. Accordingly, a motor vehicle or motorcycle can also be understood here as the machine component.

The handle arrangement is assigned a connecting part 2 which serves to connect the handle arrangement to the machine component 1. In the embodiment illustrated in FIGS. 1 and 2, the connecting part 2 permits a screw fastening to the machine component 1. In the embodiment illustrated in FIGS. 3 to 5, a clamping fastening to the machine component 1 is provided by means of the connecting part 2. Other fastening concepts can be used here.

A handle 3 which is assigned an elongate handle section 4 is coupled to the connecting part 2. The handle section 4 has a hand engagement point 5 with which the machine operator's hand customarily engages.

It can be gathered from the illustrations in FIGS. 1 and 3 that the handle section 4 in the inoperative state is oriented coaxially with respect to a handle axis 6.

The handle 3 primarily serves to introduce actuating forces acting perpendicularly to the handle axis 6. The exemplary embodiments illustrated each involve a handle 3 which can be used, for example, as a front handle 3 of an impact drilling machine, but this should not be understood as being limiting.

It can be gathered from looking at FIGS. 1 and 2 together that the handle 3 is mounted on the connecting part 2 in a manner such that it is slightly deflectable about a geometrical pivot point 7 substantially transversely with respect to the handle axis 6. Corresponding deflectability is also provided in the exemplary embodiment illustrated in FIGS. 3 to 5, but is not illustrated there.

The geometrical pivot point 7, the position of which can vary within a certain range, into a side facing the hand engagement point 5 and into a side facing away from the hand engagement point 5. In this case, the handle section 4 is arranged at least on the side facing the hand engagement point 5.

It is now essential for a damping mass element 8 to be provided, the mass center of gravity of which with respect to the pivot point 7, as seen along the handle axis 6, lies on that side of the handle 3 which faces away from the hand engagement point 5. The advantages associated therewith with regard to the damping behavior of the arrangement have been explained in the general part of the description.

Considerable structural degrees of freedom arise with the deflectability of the handle 3 together with the arrangement of the damping mass element 8 on the side facing away from the hand engagement point 5. A first view of the drawing already shows that the damping mass element 8 can be configured substantially independently of the handle section 4.

In a particularly preferred refinement, it is provided that the handle 3 is of substantially rigid configuration over the entire length thereof with regard to a bending stress about a bending axis running perpendicularly to the handle axis 6. The configuration of the handle 3 can therefore be very considerably simplified by reducing nonlinear effects.

In order to be able to realize the above-discussed dual function of the handle arrangement, namely, on the one hand, of damping the handle 3 and, on the other hand, of damping the machine component 1, in a simple manner, it is preferably provided that the mass center of gravity of the handle 3, as seen along the handle axis 6, is always arranged on that side of the handle 3 which faces the hand engagement point 5. In the face of accelerations transversely with respect to the handle axis 6, the damping mass element 8 therefore counteracts the deflection of the handle 3 about the pivot point 7. The dynamic deflection behavior upon introduction of vibrations of the machine component 1 can thereby be easily adjusted with a change of position and weight of the damping mass element 8.

With the above position of the mass center of gravity of the handle 3, a particularly advantageous behavior of the handle arrangement upon introduction of machine vibrations can be obtained. This is based on the fact that the machine vibrations have at least vibration components in the radial direction with respect to the handle axis 6.

The arrangement is now preferably undertaken in such a manner that machine-side vibrations introduced via the connecting part 2 produce inertia-induced pendulum vibrations of the handle 3 about the pivot point 7 and that the pendulum vibrations of the handle 3 and the machine-side vibrations neutralize one another at a point in the region of the handle section 4—rest point 9—in such a manner that the handle section 4 at the rest point 9 essentially does not undergo any deflection transversely with respect to the handle axis 6. At least, it is preferably such that the handle section 4 at the rest point 9 undergoes a minimum deflection transversely with respect to the handle axis 6 compared with the corresponding deflections, as seen along the handle axis 6, on both sides of the rest point 9.

The above configuration of the handle arrangement with the realization of the rest point 9 can best be clarified with the transition from FIG. 1 (inoperative state) to FIG. 2 (operating state with the handle 3 deflected).

FIG. 2 shows the moment at which the vibrations of the machine component 1 have accelerated the handle arrangement transversely with respect to the handle axis 6 via the connecting part 2. At this moment, the machine component 1 and, with the latter, the connecting part 2 have already covered a distance perpendicular to the handle axis 6, upward in FIG. 2, as part of the vibration movement.

It is of interest here that the distance covered by the machine component 1 transversely with respect to the handle axis 6, upward in FIG. 2, is neutralized at the rest point 9 by the handle 3 being pivoted in relation to the connecting part 2, around to the right in FIG. 2. FIG. 2 shows the line 6*a* of the respectively current, deflection-dependent direction of extent of the handle 3, which direction of extent deviates at the moment illustrated here from the handle axis 6 which represents the inoperative state.

The direction of movement of the machine component 1 is provided in FIG. 2 with the reference number "10" whereas it is provided with the reference number "11" in the direction of deflection of the handle 3 in relation to the connecting part 2.

The above pivoting of the handle 3 in relation to the connecting part 2 upon acceleration introduced via the connecting part 2 originates primarily from the mass distribution at the handle 3, in particular from the configuration and arrangement of the damping mass element 8, and optionally from the behavior in terms of stiffness of the mounting of the handle 3 on the connecting part 2.

In a particularly preferred refinement, the rest point 9 corresponds precisely to the hand engagement point 5 of the handle section 4, as illustrated in FIGS. 1 and 2 and in FIGS. 3 to 5. Provision is preferably made at least for the rest point 9 to be located in the direct vicinity of the hand engagement point 5.

Of particular importance for the above-explained manner of functioning of the handle arrangement according to the proposal is the correct configuration of the mounting of the handle 3 on the connecting part 2. A demand imposed on the mounting is that pivotability about the pivot point 7 has to be provided. The pivotability is provided here and preferably in all directions, i.e. cardanically to a certain extent.

A further demand imposed on the mounting of the handle 3 on the connecting part 2 is to ensure that actuating forces can be introduced into the machine component 1 transversely with respect to the handle axis 6.

A third demand imposed on the mounting of the handle 3 on the connecting part 2 is that the interaction of the damping mass element 8 with the machine component 1 should be possible with lever travels which are as small as possible in order to permit as direct an interaction as possible.

The above-discussed demands imposed on the mounting of the handle 3 can be met in a structurally simple manner by the handle 3 being coupled to the connecting part 2 via an elastically deformable damping arrangement 12, wherein the deflectability of the handle 3 about the pivot point 7 is realized by means of a corresponding configuration of the damping arrangement 12.

In a preferred refinement, the handle 3 is coupled to the connecting part 2 exclusively via the damping arrangement 12. The adjustment of the properties of the coupling between the handle 3 and connecting part 2, in particular with regard to realizing the degrees of freedom of movement of the handle 3, is therefore possible in a particularly simple manner.

To realize the damping arrangement 12, numerous possibilities are known from the prior art. The damping arrangement 12 consists here and preferably of a damping material which may be a flexible plastics material, in particular a foam material.

In particular in order to ensure that the damping arrangement 12 can damp machine vibrations in all directions in space, it is furthermore preferably provided that the damping arrangement 12 permits a deflection of the handle 3 in relation to the connecting part 2 in all directions and space. Said deflectability of the handle 3 is preferably also provided in all rotatary degrees of freedom.

The deflectability in the direction of the handle axis 6 plays a particular role here since ideally the rest point 9 does not inherently carry out any deflection transversely with respect to the handle axis 6 but rather a deflection in the direction of the handle axis 6. In order to damp the last-mentioned deflection movement, the damping arrangement 12 should be configured to be as soft as possible for deflection in the direction of the handle axis 6.

In principle, the configuration of the damping arrangement 12 is conceivable with only a single damping element 13 which preferably consists of an elastically deformable plastics material. The equipping of the damping arrangement 12 with a plurality of damping elements 13 arranged coaxially with respect to the handle axis 6 and optionally at a distance from one another is advantageous with regard to the installation but also with regard to the adjustability of the mounting of the handle 3.

In the exemplary embodiments which are illustrated here and to this extent are preferred, more than one damping element 13 is provided in each case, wherein the damping elements 13 are each configured as damping rings. As is apparent from the drawing, the damping rings 13 are oriented here coaxially with respect to the handle axis 6.

A coupling sleeve 14 which is oriented coaxially with respect to the handle axis 6 and to which the connecting part 2 is or can be connected fixedly, here even in a clamping manner, here and preferably forms part of the mounting. The at least one damping ring 13 is arranged here on the coupling sleeve 14 and furthermore provides the coupling between the coupling sleeve 14 and the handle 3.

In the arrangement illustrated in FIGS. 1 and 2, a narrow damping ring 13 close to the machine and a comparatively wider damping ring 13 close to the handle are provided in order to realize the mounting of the handle 3 on the connecting part 2. In the exemplary embodiments illustrated in FIGS. 3 to 5, two damping rings 13 close to the machine and three damping rings 13 close to the handle are provided, wherein a narrow damping element arrangement and a wide damping element arrangement are also produced here because of the homogeneity of the damping elements 13.

The damping arrangement 12 is undertaken in such a manner that the damping elements 13 are each assigned axial counterbearings 15 which, in the exemplary embodiment illustrated in FIG. 2, are provided by the coupling sleeve 14 and the machine component 1 and, in the exemplary embodiment illustrated in FIGS. 3 to 5, are provided on both sides by the connecting part 2. The handle 3 has a constriction 16 between the damping elements 13, the constriction 16 permitting interaction with the damping elements 13 in the direction of the handle axis 6.

In the exemplary embodiment illustrated in FIGS. 1 and 2, the damping mass element 8 is part of the handle section 4. By means of such an integrated arrangement, the compactness can be increased in certain applications.

However, in a particularly preferred refinement, it is provided that both the damping mass element 8 and the damping arrangement 12 are arranged in a damping section 17 of the handle 3, which damping section adjoins the handle section 4 (FIGS. 3 to 5). The damping section 17 is preferably of sleeve-shaped configuration in a first approximation.

The damping section 17 and the handle section 4 are connected to each other here and preferably via a press connection. However, it is also conceivable for use to be made here of a screw connection or similar application in order to be able to exchange the handle section 4 and/or the damping section 17 depending on the application. Connecting sections 19, 20 which correspond on both sides are provided here and preferably for the press connection between the damping section 17 and the handle section 4.

It has already been pointed out that the position of the damping mass element 8 as seen along the handle axis 6 is of particular importance. Here and preferably, the damping mass element 8 is arranged, as seen along the handle axis 6, in the region of the damping arrangement 12. The effect which can therefore be achieved in particular is that the mass center of gravity of the damping mass element 8, as seen along the handle axis 6, is arranged adjacent to the pivot point 7.

In the exemplary embodiments illustrated, the arrangement of the damping mass element 8 in the region of the damping arrangement 12 permits direct interaction of the damping mass element 8 with the connecting part 2 or with the machine component 1 without large lever travels. Therefore, as explained, the damping effect of the damping mass element 8 in relation to the machine component 1 can be optimized in a simple manner.

The damping mass element 8 here and preferably is arranged in an end region of the handle 3, namely in the end region opposite the handle section 4. It is easily possible therewith to arrange the damping mass element 8 in the vicinity of the machine component 1 in order to promote the above direct interaction.

It is worthy of mentioning in conjunction with the structural refinements of the exemplary embodiments illustrated that the handle 3, in particular the damping section 17 of the handle 3, always maintains a gap-like distance 18 in the direction of the handle axis 6 toward the machine component 1 or toward the connecting part 2 in order to ensure the discussed deflectability in the direction of the handle axis 6.

It emerges from looking at FIGS. 3 to 5 together that, in the exemplary embodiment there, the handle section 4 together with the damping section 17 form a rigid unit which, as described above, can be set into a pendulum vibration about the pivot point 7. In order to ensure the stiffness required for this in the handle section 4, a supporting tube 21 through which a fastening screw 22 extends runs through the handle section 4 axially with respect to the handle axis 6. The supporting tube 21 is supported on one side on an end piece 23 of the handle section 4 and on the other side on a driver 24 which is yet to be explained and which has a corresponding thread for the screw 22.

In particular for a precise adjustment of the position of the rest point 9, it is provided, in the exemplary embodiment illustrated in FIGS. 3 to 5, that the handle has a compensating mass element 25 which, with respect to the pivot point 7, is arranged on that side of the handle 3 which faces the hand engagement point 5, here on the end side. The compensating mass element 25 here is advantageously simultaneously the above-described end piece 23.

The connecting part 2 can preferably be fastened to the machine component 1 via a screw actuation which can be undertaken at the handle section 4. In the embodiment illustrated in FIGS. 1 and 2, the screw actuation involves the connecting part 2 being screwed into a thread of the machine component 1. In the embodiment illustrated in FIGS. 3 to 5, the connecting part 2 is assigned a tensioning mechanism 26 which can be tensioned by the actuation of a screw element 27, here a screw nut, arranged in the transition region between the handle section 4 and the damping section 17.

It is revealed in turn from looking at FIGS. 3 to 5 together that the screw element 27 is enclosed as it were loosely in a chamber formed by the handle section 4 and by the damping section 17. However, there is a certain form-fitting connection between the screw head 28 of the screw element 27, on the one hand, and the above-discussed driver 24 which namely has a corresponding driver formation 29. The engagement between the screw head 28 and the driver formation 29 is likewise provided loosely but in such a manner that the screw element 27 cannot be fully rotated in relation to the driver 24.

With the above arrangement, first of all the screw actuation is possible via the handle section 4, the driver 24 and the screw element 27. In this case, the coupling between the handle 3 and the screw element 27 has a rotatary clearance with respect to the handle axis 6 in such a manner that, with regard to a slight rotational deflection, and therefore with regard to rotatary vibration components, there is complete decoupling between the handle 3 or the handle section 4 and the screw element 27.

In the exemplary embodiment illustrated in FIGS. 3 to 5, the connecting part 2 has a tie rod 30 which extends through the coupling sleeve 14 and acts on a tensioning mechanism 26 assigned to the machine component 1 and on both sides on the coupling sleeve 14 in an axially clamping manner. In this case, the screw element 27 is in screw engagement with the tie rod 30 and thus ensures a tensile stress of the tie rod 30 and at the same time a compressive stress, i.e. an above-discussed clamping, of the coupling sleeve 14.

It is of interest in the embodiment illustrated in FIGS. 3 to 5 that the deflectability of the handle 3 in relation to the connecting part 2 radially and axially with respect to the handle axis 6 requires a further decoupling between the screw element 27 and the driver 24, namely a decoupling in the radial and axial directions with respect to the handle axis 6. Otherwise, the interaction between the screw element 27 and driver 24 would directly result in an undesirable transmission of vibrations.

It has been pointed out in the general part of the description that, in the operating state of the machine components under discussion, linear and non-linear vibrations of innumerable frequencies and directions regularly occur. Against this background, it is proposed that the coupling between the handle 3 and the machine component 1 has such a clearance, at least in the operating state, that the excitation of the handle 3 to provide the explained vibrations by means of the vibrations of the machine component 1 in at least one vibration direction originates from a substantially shocklike interaction between the handle 3 and the machine component 1. By this means, in particular with non-linear vibration components, particularly good success can be obtained both for the damping of the vibrations of the machine component 1 and for realizing the above-described rest point 9 in the handle section 4.

The order of magnitude of the above clearance between the handle 3 and the machine component 1 lies in the order of magnitude of the amplitude of the vibrations to be damped and should in particular be smaller than the maximum amplitude of the vibrations to be damped. A particularly effective damping behavior has been demonstrated therewith in tests.

It has furthermore been pointed out in the general part of the description that generally a preferred vibration direction can be assigned to the vibrations of a machine component 1, as seen statistically. A particularly preferred refinement is therefore based on said preferred vibration direction being oriented substantially transversely with respect to the handle axis 6. Correspondingly, it is preferably provided that the above clearance is realized at least transversely with respect to the handle axis 6. In the exemplary embodiments illustrated and to this extent preferred, this can easily be realized by a corresponding configuration of the damping arrangement 12, in particular of the damping rings 13.

The realization of the above clearance via a corresponding configuration of the damping arrangement is conceivable in numerous variant embodiments. Provision may be made here for the clearance also to be present in the inoperative state. However, in a preferred refinement, the clearance is formed only in the operating state. The clearance can be formed here, for example, by the elastic resetting of the damping material of the damping arrangement 12 being able to take place only after a certain relaxation time. Given a suitable configuration, a certain clearance is thus formed only after the machine component 1 has been started up, said clearance being maintained continuously via the vibrations of the handle 3.

It should also be pointed out that the damping behavior of the handle 3 is in principle also influenced by the machine operator's hand engaging at the hand engagement point 5. This can be taken into consideration additionally in the configuration with the effect of providing optimization.

According to a further teaching which likewise is of independent importance, a machine component 1 with an above-described handle arrangement is claimed as such. Reference should be made to all of the embodiments relating to a machine component of this type.

The invention claimed is:

1. A handle arrangement for a machine component which vibrates in the operating state thereof, comprising:

a connecting part configured to connect to the machine component;

a handle, comprising an elongate handle section, an engagement point, and a damping mass element, wherein:

the handle is coupled to the connecting part, the handle section, in an inoperative state, is oriented coaxially with respect to a geometrical handle axis, the handle is configured to introduce actuating forces acting perpendicularly to the handle axis, the handle is mounted on the connecting part so as to be deflectable about a geometrical pivot point substantially transversely with respect to the handle axis, wherein the geometrical pivot point lies between a mass center of gravity of the damping mass element and the hand engagement point.

2. The handle arrangement of claim 1, wherein the handle is substantially rigid over the entire length thereof with regard to a bending stress about a bending axis running perpendicularly to the handle length.

3. The handle arrangement of claim 1, wherein a mass center of gravity of the handle lies between the pivot point and the damping mass element.

4. The handle arrangement of claim 1, further comprising a rest point, wherein:

the location of the rest point is such that inertia-induced pendulum vibrations of the handle about the pivot point produced by machine-side vibrations introduced via the connecting part, and pendulum vibrations of the handle substantially cancel each other out such that the handle section at the rest point substantially does not undergo deflection transversely with respect to the handle axis compared to areas of the handle on either side of the rest point.

5. The handle arrangement of claim 4, wherein the rest point corresponds to the hand engagement point or is located in the direct vicinity of the hand engagement point.

6. The handle arrangement of claim 1, wherein the handle is coupled to the connecting part via an elastically deformable damping arrangement.

7. The handle arrangement as claimed in claim 6, wherein the damping arrangement permits a deflection of the handle in relation to the connecting part in all directions in space.

8. The handle arrangement of claim 1, wherein the damping arrangement has at least one damping element which is a damping ring, and the at least one damping element is oriented coaxially with respect to the handle axis.

9. The handle arrangement of claim 8, wherein the handle has a coupling sleeve which is oriented coaxially with respect to the handle axis and to which the connecting part is fixedly connected, in a clamping manner, and the at least one damping ring is arranged on the coupling sleeve and provides a coupling between the coupling sleeve and the handle.

10. The handle arrangement of claim 1, further comprising a damping section, wherein:

both the damping mass element and the damping arrangement are arranged in the damping section of the handle, the damping section adjoins the handle section, and the damping section and the handle section are connected to each other via a press connection, a screw connection or a fastening member.

11. The handle arrangement of claim 6, wherein the damping mass element is arranged, as seen along the handle axis, in the region of the damping arrangement, and the mass center of gravity of the damping mass element, as seen along the handle axis, is arranged adjacent to the pivot point.

12. The handle arrangement of claim 1, further comprising a compensating mass element arranged at an end of the handle opposite from the location of the pivot point.

13. The handle arrangement of claim 9, wherein the connecting part has a tie rod which extends through the coupling sleeve and acts on a tensioning mechanism assigned to the machine component and which acts on both sides on the coupling sleeve in an axially clamping manner, and a screw element is in screw engagement with the tie rod.

14. The handle arrangement of claim 1 wherein the coupling between the handle and the connecting part has a clearance, at least in the operating state.

15. The handle arrangement of claim 14, wherein the clearance is realized via the damping arrangement.

16. The handle arrangement of claim 1, wherein the damping mass element is configured to counteract deflection of the handle about the pivot point.

17. The handle arrangement of claim 1, wherein the handle is configured such that a position of the damping mass element can vary relative to the pivot point.

* * * * *